United States Patent [19]

Gminder

[11] 4,016,669

[45] Apr. 12, 1977

[54] FIREARM HAVING TRIGGER BLOCKING MECHANISM

[75] Inventor: Rolf Gminder, Altoberndorf (Neckar), Germany

[73] Assignee: Mauser-Jagdwaffen GmbH, Germany

[22] Filed: Jan. 24, 1975

[21] Appl. No.: 543,891

[30] Foreign Application Priority Data

Jan. 30, 1974 Germany ..... 7403023[U]

[52] U.S. Cl. ..... 42/70 A

[51] Int. Cl.[2] ..... F41C 17/08

[58] Field of Search ..... 42/70 A

[56] References Cited

UNITED STATES PATENTS

| | | | |
|---|---|---|---|
| 1,866,202 | 7/1932 | Floyd | 42/70 A |
| 3,715,826 | 2/1973 | Seifried | 42/70 A |

FOREIGN PATENTS OR APPLICATIONS

| | | | |
|---|---|---|---|
| 299,127 | 6/1919 | Germany | 42/70 A |

*Primary Examiner*—Charles T. Jordan
*Attorney, Agent, or Firm*—McGlew and Tuttle

[57] ABSTRACT

A firearm, and particularly a hand repeater, comprises a housing with a magazine opening adjacent the gun barrel, which includes a trigger blocking mechanism in the form of a slide which has a portion which projects into the magazine opening. The slide is biased by a spring into a position in which it blocks the trigger when there is no magazine present in the opening. The slide is displaced upon insertion of a magazine by engagement of an oblique surface portion of the magazine with the slider in order to move it against the biasing force to a position at which it no longer blocks the trigger.

5 Claims, 2 Drawing Figures

FIREARM HAVING TRIGGER BLOCKING MECHANISM

FIELD AND BACKGROUND OF THE INVENTION

This invention relates in general to the construction of firearms and, in particular, to a new and useful hand firearm, particularly a repeater, having a magazine feed mechanism which includes means displaceable by insertion of the magazine to free the trigger for operation but which is movable to block the trigger when the magazine is removed.

DESCRIPTION OF THE PRIOR ART

In general, safety mechanisms in hand firearms are intended to prevent an accidental, or even only an unintentional actuation of the trigger. There are many causes leading to an unintentional actuation of the trigger mechanism. For example, the mechanism may be released by an accidental touching or catching of the trigger in branches, or boughs, etc. Another cause may be a failure of weakness of the trigger arm spring. A further possibility of an unintentional release is the failure of the trigger arm itself or the undue wearing of the catches for the trigger. Therefore, an imperative requirement for firearms is that they have effective safety mechanisms for protection against any such accidental situation.

Many types of safety mechanisms are known for firearms. For example, the well-known carbine includes a safety wing on a particular cocking piece mounted on the breech part which is pivoted from the ready position through 180° into the safety position, and vice versa. During this operation, a cam provided on the safety rod is brought into a position before the striker nut. Such a safety mechanism has been capable of meeting the respective requirements is a completely satisfactory manner at any time. In view of the system, it has been optimal, even though a manual operation was required to bring it into effect. With small arms, and particularly repeaters, which have a magazine feeding mechanism, other safety problems are posed in addition, because when the magazine is removed, they represent a considerable danger for the user if there is a cartridge which still remains in the cartridge chamber. The removal of a cartridge which remains in a cartridge chamber of a small arm is in no way a matter of course from a technical point of view.

To eliminate this very dangerous situation, a magazine safety mechanism has come to be known, not only for automatic pistols, but also for repeaters, which is actuated by a follower after the magazine is fired and is empty. In this case, the follower controls a locking bar and retains the breech firmly in its rear position. At the same time, the cock is caught in a groove since, to a well-defined extent, the breech is not yet locked. The trigger, with its firing lever, can be freely moved without the possibility of discharging a shot. As soon as a new, full magazine is inserted, the follower again releases the locking bar so that, as usual, the breech can move forward to lock the arm and the trigger can also be actuated in the usual manner. This short description of the device makes it clear, to anyone skilled in the art, that such an operation is relatively complicated, and consequently, entails an expensive construction with high costs.

SUMMARY OF THE INVENTION

The present invention begins with the concept that it is absolutely correct to secure the trigger mechanism automatically at the removal of the magazine from the arm and it provides a safety mechanism for securing the trigger, which is simple in construction, but highly effective, and which comes into operation automatically at the removal of the magazine.

In accordance with the invention, there is provided a simple member which is in the form of a slider which is slidably guided parallel to the longitudinal axis of the arm and which, at the removal of the magazine, performs a shifting motion due to the force of its biasing spring to thereby block the trigger or a part of the trigger mechanism inherent in the system. At the insertion of the magazine into the arm, the slider performs a shifting motion in the opposite direction against the action of the spring thereby releasing the blocking.

In the preferred form of the invention, the slider is made with two forked arms with free ends with a roller journalled therein which project into the magazine opening when the magazine is removed and which will apply against the magazine under a biasing force when the magazine is positioned in the magazine opening of the housing. The opposite end of the slide is provided with a nose portion located alongside of the trigger in a position to block its pivotal movement and its operation. Part of the slide is provided with a cylindrical bore which accommodates a biasing spring which extends outwardly from a bore and is engaged at its free end against a fixed part of the housing.

Accordingly, it is an object of the invention to provide a firearm having a safety mechanism which effects the blocking of the pivotal movement of the trigger whenever a magazine is removed from a magazine compartment or opening.

A further object of the invention is to provide a trigger safety mechanism which includes a slide on a gun housing which is biased so as to project a contact portion into a magazine opening so that another portion of the slide is in a position to block the trigger action and which may be moved by insertion of a magazine against its biasing force to position the other portion of the slide so that it frees the trigger for operation.

A further objct of the invention is to provide a firearm construction, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
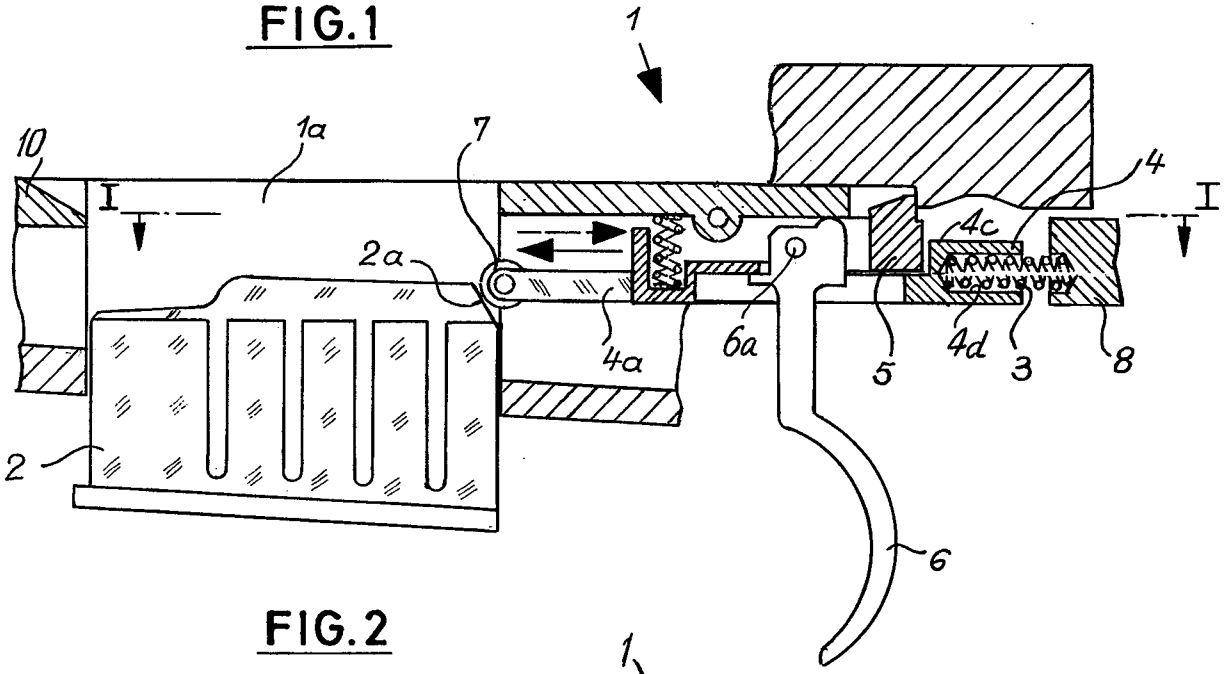
FIG. 1 is a longitudinal sectional view of a repeater firearm with a trigger and magazine feed mechanism constructed in accordance with the invention.
Figure 2:
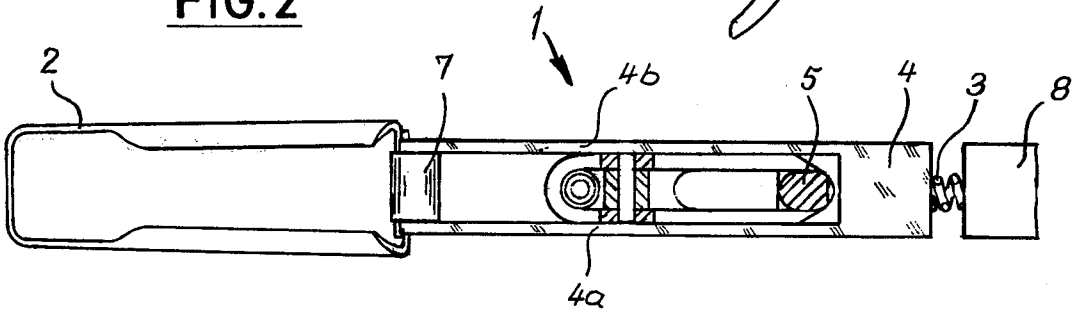
FIG. 2 is a section taken along the line 1—1 of FIG. 1.

Referring to the drawing in particular, the invention embodied therein, comprises a gun housing, generally designated 1, including a magazine opening or a recess 1*a*, adjacent the inner end of a gun barrel 10. The firearm comprises a repeater with a magazine feed mechanism and a magazine 2 is insertable in the receiving recess 1*a*. The gun is fired by actuating a trigger 6 which is pivoted at 6*a* on the housing.

In accordance with the invention, a safety device is provided for ensuring that the trigger 6 cannot operate when the magazne 2 is removed. For this purpose, a slide member or slider 4 is mounted in the housing for sliding movement toward and away from the magazine opening 1*a* and in the direction of the longitudinal axis of the firearm. Slider 4 includes a widened diameter portion 4*c* having an internal bore 4*d* which accommodates a coil spring 3 which forms biasing means for biasing the slider in a direction toward the magazine recess 1*a*. One end of the spring 3 is retained within bore 4*d*, and the opposite end is retained on a fixed abutment 8 of the housing.

In FIG. 1 of the drawing, magazine 2 is shown in a position before it is inserted into receiving recess 1*a*, in which case, a forked end of slider 4, comprising two spaced apart leg portions 4*a* and 4*b*, are positioned so that the outer ends which are provided with a roller 7 therebetween project into the recess 1*a*. In this same position, the widened portion 4*c* forms a blocking shoulder for a trigger sear 5 or other part of the trigger 6 so that the trigger cannot be moved.

When magazine 2 is fully inserted and pushed up further, an oblique surface 2*a* contacts the roller 7 and causes a shifting movement of the slider to the right against the biasing force produced by the spring 3. When this occurs, the widened portion 4*c*, which forms the shoulder, is moved out of the way of the trigger sear 5 to release the trigger for operation.

The oblique surface 2*a* of the magazine 2 is dimensioned so that the slider 4 is moved back through a correspondingly long distance. Care is taken to ensure that the slider 4 is not moved from its guide track in the housing, when oblique surface 2*a* runs against the housing. Instead of a trigger sear 5, the trigger 6 may be provided with an arm portion or other portion (not shown) which may be blocked so as to prevent the pivoting movement of the trigger as desired.

The invention has numerous advantages:

As compared to the prior art, the inventive safety mechanism is quite simple in construction. Instead of a plurality of parts which are complicated in manufacture and which due to many bearing points and operational surfaces are subject to wear, the inventive safety mechanism comprises a flat forked slider which is relatively simple in design and consequently relatively inexpensive to manufacture. Since it moves relatively slowly, it is practically free of operational wear. By choosing a suitable biasing means in the form of a spring 3, an appropriate or computed biasing of the slider may be effected, and this may be varied within relatively broad limits. Only the widened portion 4*c*, which forms a shoulder which blocks the operation of the trigger, need be formed of a material which must be wear-resistant. Even so, this portion is smooth and has a planar surface so that it does not have to be subjected to any special hardening treatment. Such a safety mechanism is very reliable in operation and, in comparison to the prior art, relatively inexpensive to manufacture.

While a specific embodiment of the invention has been shown and described in detail to illustrate the application of the principles of the invention, it will be understood that the invention may be embodied otherwise without departing from such principles.

What is claimed is:

1. A firearm, comprising a housing, a gun barrel mounted on said housing, a magazine opening in said housing adjacent said gun barrel, a trigger pivotally mounted on said housing adjacent said magazine opening, a slider movable on said housing adjacent the magazine opening and said trigger and having a magazine contact portion positionable in the magazine opening and a trigger blocking portion positionable at a location to block the movement of the trigger when said magazine contact portion is in the magazine opening, said slider being displaceable upon insertion of a magazine into the opening to contact said magazine contact portion to shift said contact portion and said slider out of the opening and to position said trigger blocking portion in a position away from said trigger, so that said trigger can be moved, and biasing means for biasing said slider in a direction toward the magazine opening, said magazine contact portion including two spaced apart arms having a roller therebetween engageable with the magazine.

2. A firearm, according to claim 1, wherein said trigger blocking portion comprises a widened portion forming a shoulder which is engageable behind said trigger.

3. A firearm, according to claim 1, wherein said trigger blocking portion comprises a widened portion of said slider having an internal bore, said biasing means comprising a spring in said bore having one end engaged on said slider and an opposite end engaged against said housing.

4. A firearm, according to claim 3, wherein said spring comprises a helical spring.

5. A hand repeater firearm, comprising a housing having a magazine chamber with a magazine insertion opening, a barrel mounted on said housing in front of said magazine chamber, a slideway in said housing extending from the said magazine chamber rearwardly, said housing having a fixed portion alongside one end of said slideway which is opposite to said magazine chamber, a trigger pivoted in said housing and having a portion in said slideway, a slider in said slideway having a widened rear portion forming a trigger blocking member and having an axial bore therein opening rearwardly, a coil spring in said bore and engaged against said housing fixed portion and biasing said slider toward said magazine chamber and said trigger blocking member into engagement with a portion of said trigger to block movement of said trigger, said slider being bifurcated and having leg portions on each side of said trigger which extend forwardly of said trigger and project into said magazine chamber, roller means on said leg portions adjacent the ends thereof which project into said magazine chamber, a magazine insertable in said magazine chamber having an engagement edge adjacent said slider and engageable with said slider to move it against said biasing means to move said trigger blocking member away from said trigger to permit operation thereof.

* * * * *